US006357451B1

(12) United States Patent
Carter

(10) Patent No.: US 6,357,451 B1
(45) Date of Patent: Mar. 19, 2002

(54) APPARATUS AND METHOD FOR FORMING AN IMITATION FINGER NAIL

(76) Inventor: Gerri Carter, 625 San Mateo, NE., Albuquerque, NM (US) 87108

( * ) Notice: Subject to any disclaimer, the term of this patent is extended or adjusted under 35 U.S.C. 154(b) by 0 days.

(21) Appl. No.: 09/431,882

(22) Filed: Nov. 2, 1999

Related U.S. Application Data

(60) Provisional application No. 60/107,994, filed on Nov. 11, 1998.

(51) Int. Cl.[7] ..... A45D 29/00
(52) U.S. Cl. ..... 132/200; 132/73; 132/285
(58) Field of Search ..... 132/73, 200, 285; D28/57

(56) References Cited

U.S. PATENT DOCUMENTS

| | | | | | |
|---|---|---|---|---|---|
| 2,288,386 | A | * | 6/1942 | Belden | 132/73 |
| 2,323,145 | A | * | 6/1943 | Mabry | 132/285 |
| 2,799,282 | A | * | 7/1957 | Black | 132/73 |
| 3,245,418 | A | * | 4/1966 | Dinerstein | 132/285 |
| 3,382,878 | A | * | 5/1968 | Dinerstein | 132/285 |
| 3,478,756 | A | * | 11/1969 | Sautter et al. | 132/73 |
| 4,157,095 | A | * | 6/1979 | Sweet | 132/73 |
| 4,577,648 | A | * | 3/1986 | Dinerstein et al. | 132/73 |
| 4,924,889 | A | * | 5/1990 | Schaeffer et al. | 132/73 |
| 5,209,250 | A | * | 5/1993 | Taeckens | 132/73 |
| 5,638,837 | A | * | 6/1997 | Juhl et al. | 132/73 |
| 6,012,461 | A | * | 1/2000 | McKew | 132/73 |
| D426,919 | S | * | 6/2000 | Bachik | D28/57 |

FOREIGN PATENT DOCUMENTS

| | | | | |
|---|---|---|---|---|
| AT | 178165 | * | 4/1954 | 132/73 |
| DE | 4335527 | * | 2/1994 | 132/73 |
| FR | 2606611 | * | 5/1988 | 132/73 |

* cited by examiner

*Primary Examiner*—Todd E. Manahan
(74) *Attorney, Agent, or Firm*—Law Offices of Ray R. Regan

(57) ABSTRACT

An apparatus and method for forming an imitation finger nail. An apparatus for forming an imitation finger nail includes a flexible sheet. Each sheet may be provided with a self-adhesive material on one side of the sheet. A removable cap is formed in the sheet. In addition, a slot may be formed in the sheet for engaging a finger nail. A plurality of substantially parallel lines may be provided on a first surface of the sheet adjacent the slot. A plurality of substantially curved lines intersecting the substantially parallel lines also may be provided on the first surface of the sheet. One or more ears attached to opposite edges of the sheet are provided for helping to secure the bendable and conformable sheet to a finger.

16 Claims, 5 Drawing Sheets

APPARATUS AND METHOD FOR FORMING AN IMITATION FINGER NAIL

CROSS-REFERENCE TO RELATED APPLICATION

As provided in 35 U.S.C. §119, applicant claims priority to this nonprovisional patent application based on the copending provisional United States patent application filed by applicant, the sole inventor, filed in the United States Patent and Trademark Office on Nov. 11, 1998, Application Number 60/107,994.

FEDERALLY SPONSORED RESEARCH AND DEVELOPMENT

None.

FIELD OF THE INVENTION

The present invention pertains generally to the field of forming an imitation finger nail on a finger nail of a human, the term "finger" including a thumb as well as all other fingers on a human hand. More particularly, the present invention pertains to an apparatus and method for forming a predictable and uniformly shaped imitation finger nail. The present invention is particularly, but not exclusively, useful for shaping and sculpting an imitation finger nail both to provide a uniform imitation finger nail and to disclose a well-defined lunula associated with an imitation finger nail.

BACKGROUND OF THE INVENTION

Application of synthetic materials to finger nails, including a thumb nail (individually, a "finger nail," and collectively, "finger nails") to provide a longer, attractive, or more uniformly shaped imitation finger nail is a complex, technical process requiring that a technician who is applying synthetic materials to finger nails ("technician") possess significant levels of manual dexterity, artistic capabilities, a variety of tools, and infinite patience. For many technicians, the current processes are not readily mastered. The results, therefore, are neither predictable nor uniform in appearance.

Customer demand, however, requires that a technician be able to mount synthetic materials on finger nails in a manner to produce an artificial or imitation synthetic finger nail ("imitation finger nail") that is securely mounted on an underlying actual, real finger nail of a customer (referred to either as "finger nail" or, for emphasis, "true finger nail"). The technician also must be able to shape synthetic materials, including acrylic compounds, to produce an imitation finger nail that appears to be an authentic true finger nail. The technician, therefore, must be able to shape and sculpt synthetic materials into an imitation finger nail that substantially replicates in appearance the anatomical features of a true finger nail, including the free margin (the distal end of a true finger nail that often is clipped to control finger nail growth) and the lunula (the substantially pink portion of epidermis extending distally from the cuticle of a true finger nail). A technician also must be able to shape and sculpt an imitation finger nail that is anatomically consistent with other components of a true finger nail, including the nail matrix (the proximal edge of a finger nail not usually visible because it is subtended by the cuticle), the body of the true finger nail, the sole of the finger (the distal end of a finger beneath the free margin of a true finger nail), and the nail bed (that portion of the epidermis on which a true finger nail rests).

A technician also must be able to reshape an imitation finger nail. One process for reshaping an imitation finger nail is known as backfilling. After an imitation finger nail is formed on a true finger nail, a finger nail will, of course, grow. An imitation finger nail will, therefore, because the imitation finger nail is attached to a growing finger nail, begin to extend distally outward from a lunula on a true finger nail, and from the location on which the technician positioned the imitation finger nail, resulting in a gap. A gap generally is formed between the proximal end of the imitation finger nail and the cuticle of the true finger nail. A technician, therefore, must be capable of applying synthetic materials to the gap by, for example, the process of backfilling the gap.

Consumer demand to produce an imitation finger nail that appears to be a true finger nail requires the technician to shape and sculpt an imitation finger nail to disclose a portion of the imitation finger nail that appears to replicate the substantially pink lunula of a true finger nail. In addition, many customers require a technician to apply imitation finger nails in such a way as to produce a variety of different contours and shapes of visible lines defining the lunula ("lunula line"). For example, customers may require a lunula line to be substantially natural, substantially triangular, substantially semicircular, or other configurations.

Current apparatus and methods for achieving such results are complex, costly, unpredictable, and time-consuming. Current apparatus and methods also require the technician to possess significant technical skills associated with using and operating various tools and equipment available for achieving such results. For example, one form of lunula line sought by customers is the "French smile line." The French smile line, using current apparatus and methods for backfilling, is achieved by use of a cone-shaped drill bit affixed to a hand-held drill. After painstakingly carving a white lunula line, the technician must also employ one or more additional drill bits to shape and sculpture the free edge of the imitation finger nail. The current steps are inherently problematical because the technician must guess how deep into the synthetic material to drill, yet avoid contact with the nail bed. A variety of techniques and methods are used by technicians to reduce guessing associated with those objectives, but none has proven predictable. For example, some technicians draw a lunula line on the imitation finger nail with a pencil before using a drill bit to trench the desired shape and configuration of the lunula line. If the trenched lunula line is proven incorrect, substantial time and cost is lost trying to correct the mistake with replacement synthetic material.

Another problem associated with current apparatus and methods for forming an imitation finger nail is reduction of the thickness of the true finger nail. Currently, a technician may file or nip the synthetic material applied to a true finger nail. In the process of filing or nipping the synthetic material, a portion of the true finger nail may also be removed by nipping. It would be preferable for the technician to be able to file or otherwise abrade unwanted synthetic material being used to form an imitation finger nail from areas adjacent to the lunula line, and reapply synthetic material using an apparatus that provides a substantially consistent, uniform lunula line.

A problem to be solved, therefore, is to provide an apparatus, and a method for using the apparatus, that provides an imitation finger nail having the appearance of a true finger nail that is simple to practice, cost effective, does not require substantial manual dexterity to use or apply, allows the technician to provide a variety of lunula lines, and yields predictable, uniform results.

In light of the above, it is an object of the present invention to provide an apparatus and a method for using the apparatus that provides the appearance of a true finger nail that is simple to practice, cost effective, does not require substantial manual dexterity to use or apply, allows the technician to provide a variety of lunula lines, and yields predictable, uniform results.

Yet another object of the present invention is to provide an apparatus and method of using the apparatus that produces an imitation finger nail that is securely mounted on a finger nail.

Another object of the present invention is to provide an apparatus and method of using the apparatus that produces an imitation finger nail that substantially replicates in appearance the anatomical features of a finger nail.

Still another object of the present invention is to provide an apparatus and method of using the apparatus that will produce a variety of shapes and contours of lunula lines associated with an imitation finger nail.

Another object of the present invention is to provide an apparatus and method of using the apparatus that minimizes degradation of the true finger nail by permitting a technician to use less synthetic material adjacent the true finger nail while forming a substantially predictable and consistent lunula line on the imitation finger nail.

Still another object of the present invention is to provide an apparatus for backfilling the gap that occurs as the true finger nail grows after installation of an imitation finger nail on the true finger nail.

Yet another object of the present invention is to provide an apparatus for forming an imitation finger nail, and a method for using the apparatus, which respectively are easy to use and to practice, and which are cost effective for their intended purposes.

These and other objects, features, and advantages of such a an apparatus for forming an imitation finger nail will become apparent to those skilled in the art when read in conjunction with the accompanying following detailed description, drawing figures and claims.

SUMMARY OF THE INVENTION

An apparatus for forming an imitation finger nail, according to the present invention, includes a bendable, conformable, generally flexible sheet. The sheet may be provided individually or provided on a roll of paper or other material on which a number of sheets are removably attachable. One means of providing removably attachable sheets is to demountably afix by gluing, applying an adhesive, or other means well known in the art a plurality of sheets to the roll of paper or other material on which a plurality of sheets is removably attached. Each sheet in the plurality of sheets also is readily separable and detachable from an adjoining sheet and from the roll of paper or other material. Each sheet of the present invention also includes a self-adhesive material on one side of each sheet that is placed in contact with a true finger nail. The self-adhesive applied to the sheet may assist in enabling a technician to position a sheet where the technician wants to locate the sheet on a finger nail.

An apparatus for forming an imitation finger nail, according to the present invention, also includes a cap that is formed in the sheet. The cap is removable from the sheet. The cap provides a user of the present invention, such as a technician, a view of a portion of a finger, lunula, and finger nail when the sheet is attached to a finger as described in this instrument. The present invention also includes a slot. The slot is formed in the sheet. The slot formed in the sheet permits a technician to insert a finger nail through the slot. When a finger nail has been inserted through the slot formed in the sheet, a technician may begin the process of mounting synthetic material on the finger nail inserted through the slot. Because the sheet of the present invention is made of flexible material, and includes a self-adhesive material on the side of the sheet facing a finger on which the sheet has been installed, the slot may be snugged and formed around the base of a finger nail in a variety of ways to enable the technician to mount synthetic material or materials on the finger nail.

An apparatus for forming an imitation finger nail, according to the present invention, may also include a plurality of substantially parallel lines provided on a first surface of the sheet, adjacent the slot. In addition, the present invention also may include a plurality of substantially curved lines. The substantially curved lines may intersect the substantially parallel lines on the first surface of the sheet. The intersection of the substantially parallel lines with the substantially curved lines, according to the present invention, provides a technician with one or more reference lines useful in forming the imitation nail on the finger nail.

The present invention also includes one or more ears attached to opposite edges of the sheet for securing the flexible, bendable and conformable sheet to a finger so that, during the process of applying synthetic materials to the finger nail, the sheet remains substantially secure on a finger.

The foregoing has outlined broadly the more important features of the invention to better understand the detailed description which follows, and to better understand the contribution of the present invention to the art. It is to be understood that the invention is not limited in application to the details of construction, and to the arrangements of the components, provided in the following description or drawing figures. The invention is capable of other embodiments, and of being practiced and carried out in various ways. Also, the phraseology and terminology employed in this disclosure are for purpose of descriptions and should not be regarded as limiting.

As those skilled in the art will appreciate, the conception on which this disclosure is based readily may be used as a basis for designing other structures, methods, and systems for carrying out the purposes of the present invention. The claims, therefore, include such equivalent constructions to the extent the equivalent constructions do not depart from the spirit and scope of the present invention. Further, the abstract associated with this disclosure is neither intended to define the invention, which is measured by the claims, nor intended to be limiting as to the scope of the invention in any way.

The novel features of this invention, and the invention itself, both as to structure and operation, are best understood from the accompanying drawing, considered in connection with the accompanying description of the drawing, in which similar reference characters refer to similar parts, and in which:

DESCRIPTION OF THE PREFERRED EMBODIMENTS

Figure 1:
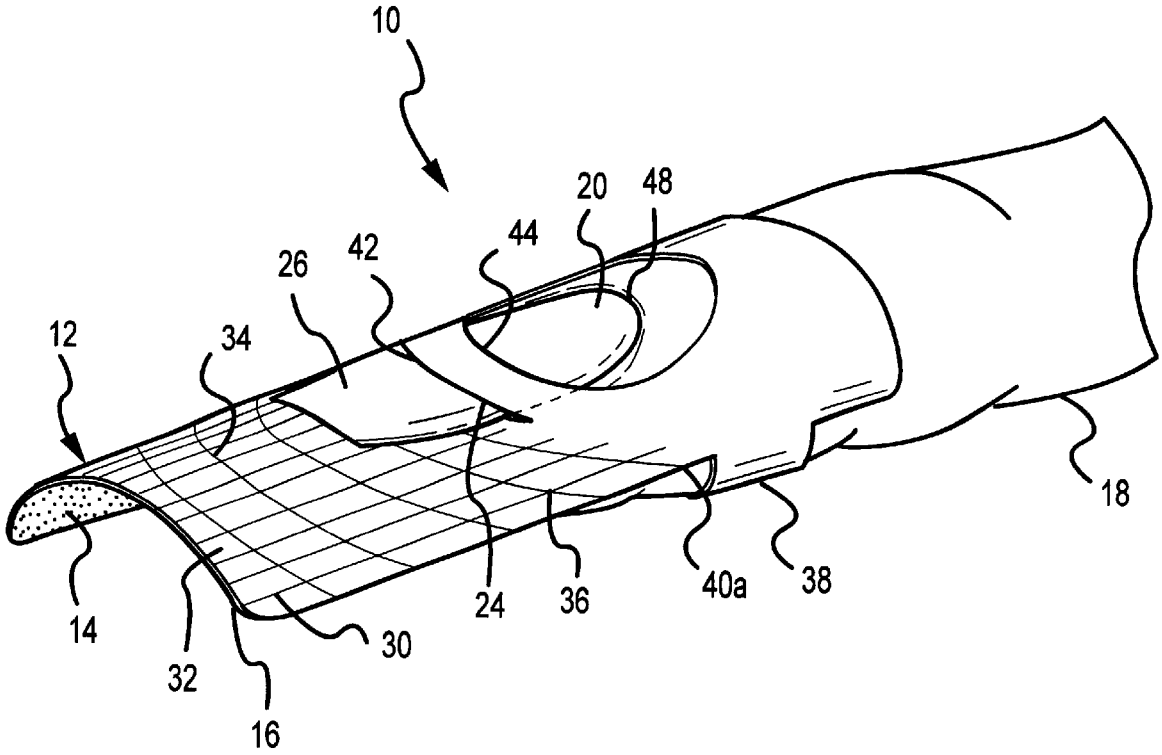
FIG. 1 is a perspective view of the an apparatus for forming an imitation finger nail in an operative environment.
Figure 2:
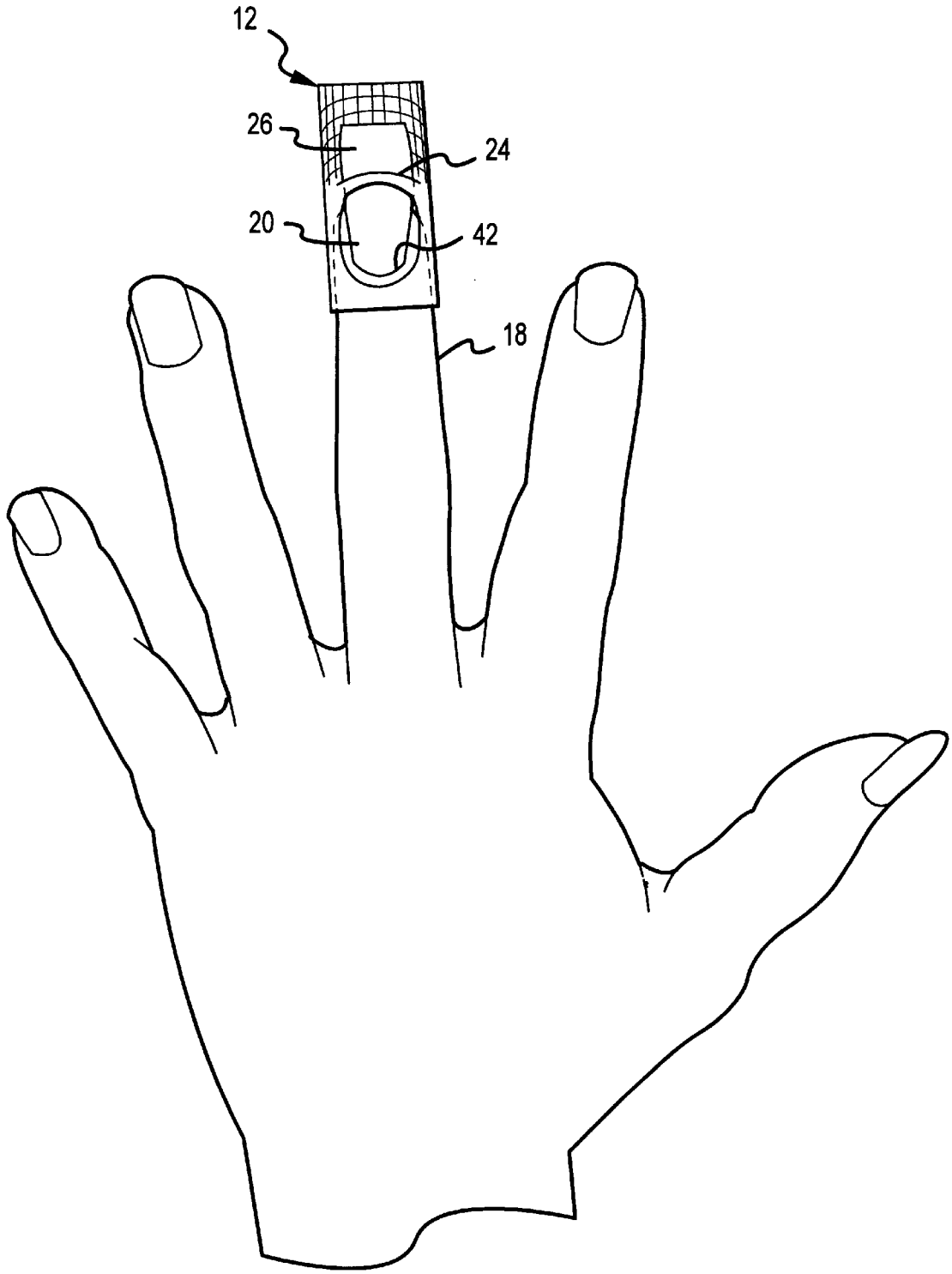
FIG. 2 is a perspective view of an apparatus for forming an imitation finger nail shown in another operative environment from a top view.

Referring initially to FIG. 1, the apparatus for forming an imitation finger nail is shown and generally designated 10. As shown, apparatus for forming an imitation finger nail 10 includes a flexible, bendable and conformable sheet 12. Sheet 12 may be provided individually or provided on a roll of paper or other material (not shown) on which a number of sheets 12 are removably attachable. One way to provide removably attachable sheets is to attach a plurality of sheets 12 to paper or other material by glue, adhesive, or similar material that allows a sheet to be removed readily from the paper or other material on which sheet 12 or a plurality of sheets 12 have been located. Each sheet 12 in the plurality of sheets also is readily separable from an adjoining sheet 12. One way to provide that each of a plurality of sheets 12 in a plurality of sheets 12 is separable from an adjacent sheet 12 is to perforate or precut each such sheet while the plurality of sheets 12 remain readily removable from the roll of paper or other material because of an adhesive 14 applied to a second side 16 of each such sheet 12. For example, each sheet 12 of the present invention may include an adhesive material 14 (shown by cross-hatched lines on FIG. 1) on second side 16 of each sheet 12 that also may be placed in contact with a finger 18 and a true finger nail 20. Self-adhesive material 14 applied to sheet 12 assists in enabling a technician to position sheet 12 where a technician wants to locate sheet 12 on finger 18 and true finger nail 20.

Figure 3:
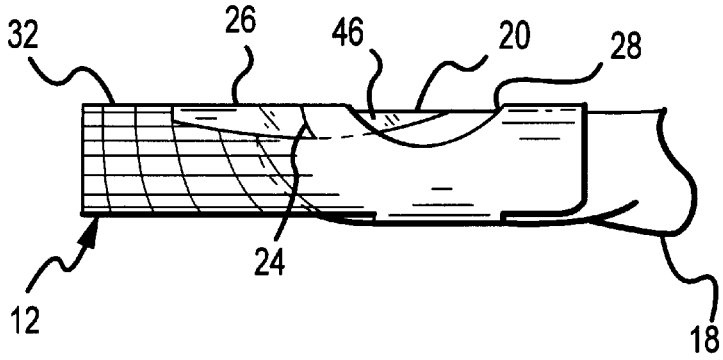
FIG. 3 is a side perspective view of an apparatus for forming an imitation finger nail shown engaged with a finger.
Figure 4:
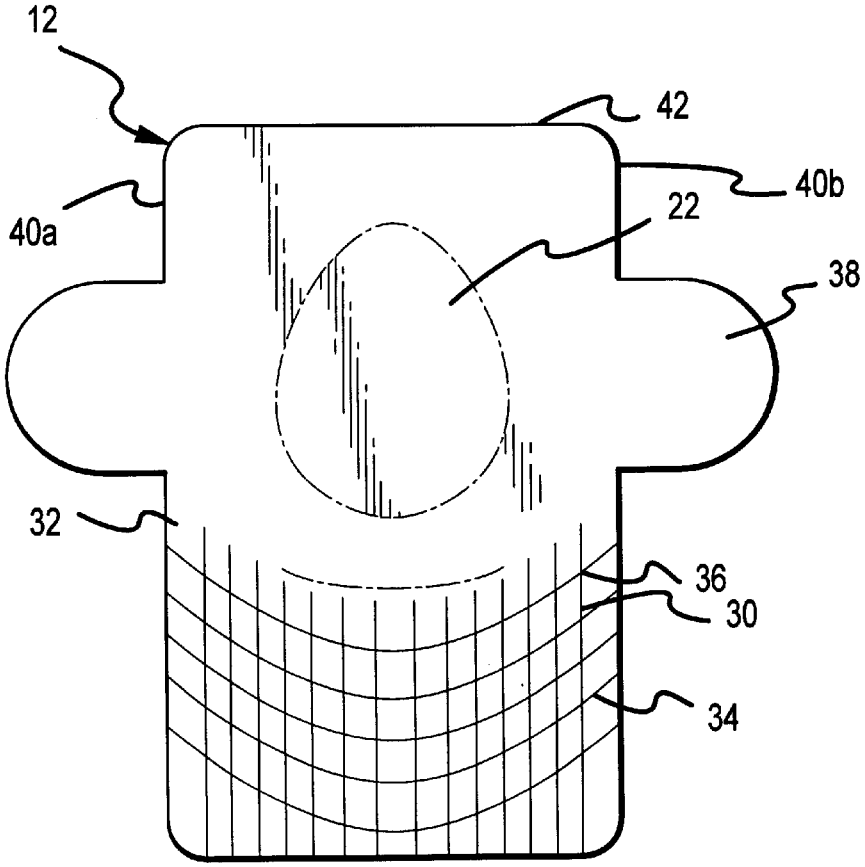
FIG. 4 is a top plan view of an apparatus for forming an imitation finger nail.
Figure 5:
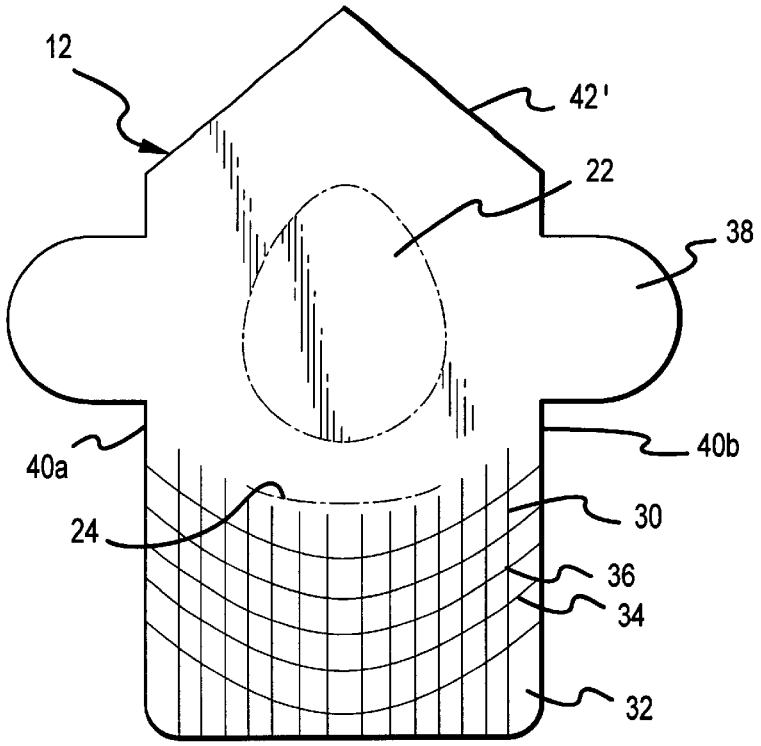
FIG. 5 is a top plan view of an alternative embodiment of an apparatus for forming an imitation finger nail.
Figure 6:
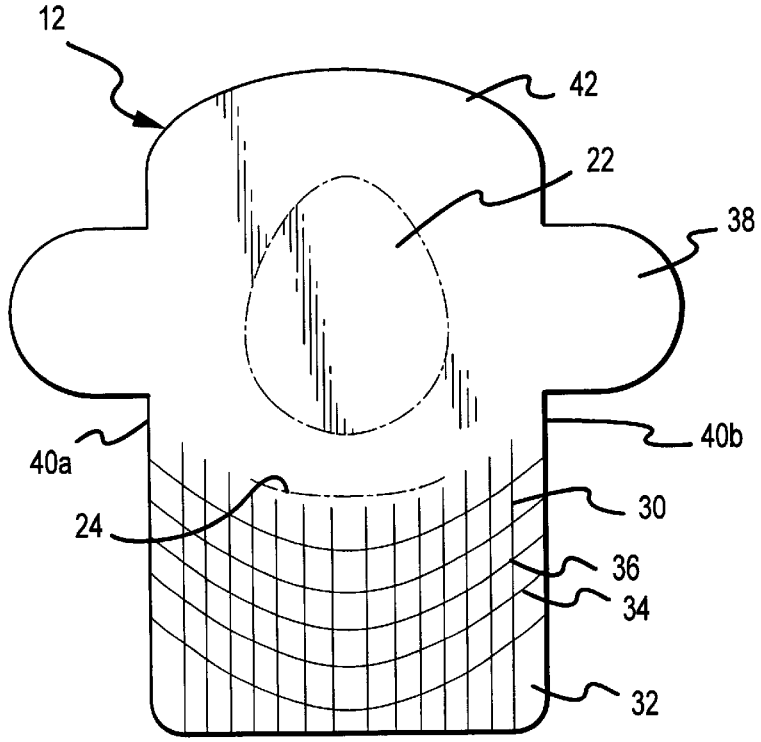
FIG. 6 is a top plan view of another alternative embodiment of an apparatus for forming an imitation finger nail.

An apparatus for forming an imitation finger nail 10, according to the present invention, also includes a removable cap 22 as best shown by cross-reference between FIGS. 4–6 that is formed in sheet 12. Removable cap 22 provides a user of the present invention, such as a technician, a view of a portion of finger 18 and true finger nail 20 on which sheet 12 is removably attached. The present invention also includes a slot 24 formed in sheet 12, as best seen by cross-reference between FIGS. 1 through 5. As best a shown in cross-reference among FIGS. 1 through 5, slot 24 formed in sheet 12 permits a technician to engage true finger nail 20 and imitation finger nail 26 through slot 24. After engaging true finger nail 20 or imitation finger nail 26 in slot 24 formed in sheet 12, a technician may begin the process of mounting synthetic material on true finger nail 20 engaged in slot 24. Because sheet 12 of the present invention is made of flexible material, and may include adhesive material 14 on second side 16 of sheet 12 facing finger 18, slot 24 may be snugged and formed around the base 28 of true finger nail 20, as best shown in FIG. 3, in a variety of ways to enable the technician to mount synthetic material or materials on true finger nail 20, as best shown by cross-reference between FIGS. 1 and 3.

As also shown in FIGS. 1 and 4–6, an apparatus for forming an imitation finger nail 10, according to the present invention, may also include a plurality of substantially parallel lines 30 provided on a first surface 32 of sheet 12 extending distally from slot 24. In addition, the present invention may include a plurality of substantially curved lines 34 intersecting substantially parallel lines 30 on first surface 32 of sheet 12. Intersections 36, as best shown by cross-reference between FIGS. 2 and 4, of substantially parallel lines 30 and substantially curved lines 34, according to the present invention, collectively provide a technician with one or more reference lines useful in forming imitation nail 26 on true finger nail 20.

As shown in FIG. 4, the present invention also includes one or more ears 38 attached to opposite edges 40 of sheet 12, as shown in FIG. 4 and also in FIG. 1, for securing flexible sheet 12 to finger 18 so that during the process of applying synthetic materials to finger nail 20, sheet 12 remains substantially secure on finger 18.

Figure 7:
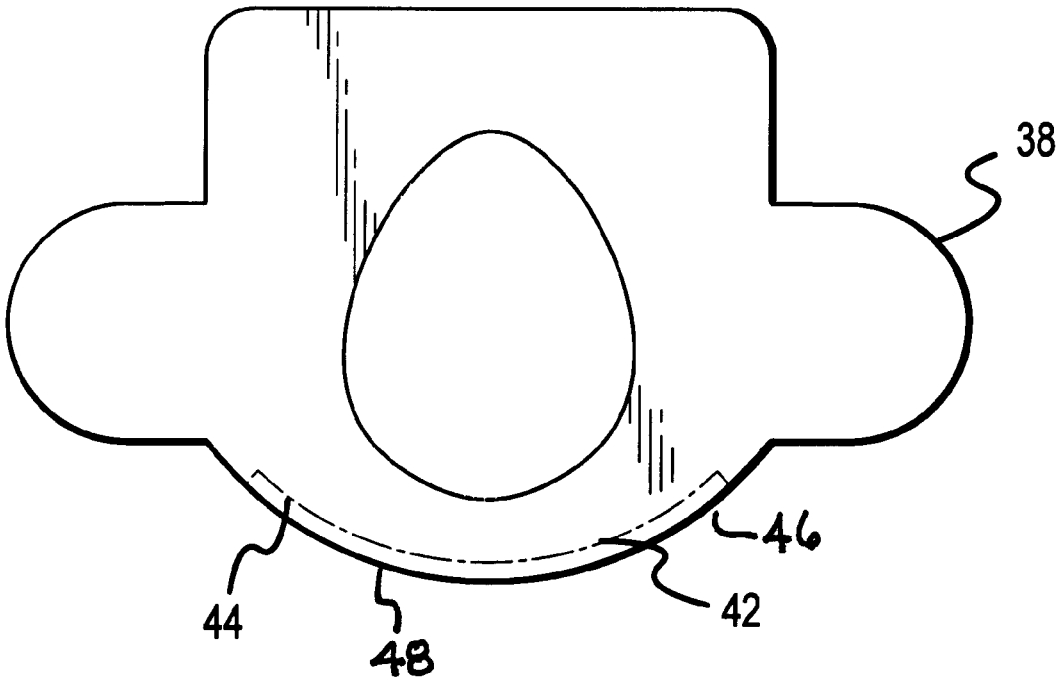
FIG. 7 is a top plan view of another alternative embodiment of an apparatus for forming an imitation finger nail without lines for alignment.

As shown in FIGS. 5 and 6, sheet 12 may be provided in a variety of configurations for forming different shaped lunula lines 42 in an imitation finger nail 26. For example, as shown in FIG. 1, lunula line 42 will appear in imitation finger nail 26 as a substantially curved line that replicates a lunula of a true finger nail 20. FIG. 5 shows an alternative embodiment of an apparatus for forming an imitation finger nail 10 that includes a lunula line 42' shape that permits a technician to sculpt a lunula line 42' substantially in the shape of a triangle. Still another embodiment of the present invention is shown in FIG. 7, shown without a plurality of substantially parallel lines 36, provided on first surface 32 of sheet 12, and without a plurality of substantially curved lines 34 intersecting substantially parallel lines 36 on first surface 32. FIG. 7 also shows an alternative embodiment of the present invention without a slot 24. FIG. 7 discloses an embodiment that includes one or more perforations 44 in sheet 12. Perforations 44 assist a technician in removably securing sheet 12 to finger nail 20. Perforations 44 also may be used by a technician to bend sheet 12 up along the perforations to form a front surface 46 and a rear surface 48. A technician may use rear surface 48 as a backboard against which synthetic material may be massed to preclude movement of the synthetic material while being shaped into imitation finger nail 26. As will be evident to one skilled in the art, any number of alternative embodiments of the present invention, as shown in FIG. 7, may be provided with any number of shapes for lunula line 42.

In operation, after a technician has cleaned, repaired and otherwise prepared the surface of true finger nail 20 or preexisting imitation nail 26, removable cap 22 may be removed from sheet 12 and an apparatus for forming an imitation finger nail 10 may be place on finger 18 and finger nail 20. Finger nail 20 or preexisting imitation nail 26 may be inserted through slot 24 in the embodiment of the present invention shown in FIG. 1. Lunula line 42 of an apparatus for forming an imitation finger nail 10 is located on finger nail 20 or preexisting imitation nail 26 by locating lunula line 42 behind preexisting lunula line 44, as shown in FIG. 1, as seen through opening 46 in sheet 12, best shown in FIG. 3, created by removing removable cap 22 from sheet 12. An apparatus for forming an imitation finger nail 10 also is located on finger 18 distally from cuticle 48 on finger 18. The technician may press sheet 12 against finger 18. Adhesive material 14 on second side 16 of sheet 12 will assist in securing sheet 12 on finger 18. Ears 38 also may be folded on finger 18 to assist in securing sheet 12 on finger 18. Synthetic material may then be applied adjacent lunula line 42 of An apparatus for forming an imitation finger nail 10, using lunula line 42 as a guide. Sheet 12 may be removed, and imitation nail 26 completed by the technician.

The foregoing has outlined broadly the more important features of the invention to better understand the detailed description which follows, and to better understand the contribution of the present invention to the art. It is to be understood that the invention is not limited in application to the details of construction, and to the arrangements of the components, provided in the following description or drawing figures. The invention is capable of other embodiments, and of being practiced and carried out in various ways. Also, the phraseology and terminology employed in this disclosure are for purpose of descriptions and should not be regarded as limiting.

As those skilled in the art will appreciate, the conception on which this disclosure is based may be readily used as a basis for designing other structures, methods, and systems for carrying out the purposes of the present invention. The disclosure is intended to cover equivalent construction that do not depart from the spirit and scope of the present invention.

While the apparatus for forming an imitation finger nail shown in the drawing figures is one embodiment of the present invention, it is merely one embodiment of the invention, is not intended to be exclusive, and is not a limitation of the present invention.

While the particular an apparatus for forming an imitation finger nail as shown and disclosed in detail in this instrument is fully capable of obtaining the objects and providing the advantages stated, this disclosure is merely illustrative of the presently preferred embodiments of the invention, and no limitations are intended in connection with the details of construction, design or composition other than as provided and described in the appended claims.

What is claimed is:

1. An apparatus for forming an imitation finger nail and lunula line, comprising:

a sheet;

a cap formed in the sheet for defining an opening;

a slot formed in the sheet noncontiguously with the opening; and means for removably attaching the sheet to a true finger nail on a finger.

2. An apparatus for forming an imitation finger nail as recited in claim 1, further comprising a plurality of interconnectably separable sheets.

3. An apparatus for forming an imitation finger nail as recited in claim 1, wherein the sheet is formed of flexible material.

4. An apparatus for forming an imitation finger nail as recited in claim 1, wherein the cap is removable from the sheet.

5. An apparatus for forming an imitation finger nail as recited in claim 1, wherein the removably attaching means includes one or more ears extending from opposing edges of the sheet.

6. An apparatus for forming an imitation finger nail on a true finger nail, comprising:

a sheet;

a cap formed in the sheet;

a slot formed in the sheet, said slot positioned between the cap and the finger nail; and one or more ears extending from opposing edges of the sheet.

7. An apparatus for forming an imitation finger nail on a true finger nail as recited in claim 6, wherein the sheet is made of flexible material.

8. An apparatus for forming an imitation finger nail on a true finger nail as recited in claim 7, wherein the cap is removable from the sheet.

9. An apparatus for forming an imitation finger nail on a true finger nail as recited in claim 8, wherein the sheet is further formed with a first surface and a second surface, said second surface having an adhesive.

10. An apparatus for forming an imitation finger nail on a true finger nail as recited in claim 9, wherein the sheet further comprises means for aligning the imitation finger nail on the true finger nail.

11. An apparatus for forming an imitation finger nail on a true finger nail as recited in claim 10, wherein the aligning means comprises a plurality of substantially parallel lines provided on the first surface of the sheet.

12. An apparatus for forming an imitation finger nail on a true finger nail as recited in claim 11, wherein the plurality of substantially parallel lines is further provided adjacent the slot.

13. An apparatus for forming an imitation finger nail on a true finger nail as recited in claim 12, wherein the aligning means further includes a plurality of curved lines intersecting the substantially parallel lines on the first surface.

14. An apparatus for forming an imitation finger nail on a true finger nail as recited in claim 13, wherein the one or more ears is further formed to be engageable with a finger.

15. A method for forming an imitation nail, comprising the steps of:

providing a flexible sheet interconnectably separable from a plurality of sheets having a first surface and a second surface;

incising a removable cap formed in the sheet;

providing a slot for engaging the sheet with a finger nail;

fitting one or more ears to opposing edges of the sheet;

attaching the sheet to a finger nail on a finger nail;

inserting a finger nail through the slot;

bending the one or more ears to engage the one or more ears with a finger; and applying a synthetic material to the finger nail to form an imitation nail.

16. A method for forming an imitation nail as provided in claim 13, wherein the engaging step includes the substep of providing one or more perforations in the sheet.

* * * * *